US007273145B2

(12) United States Patent
Focke et al.

(10) Patent No.: US 7,273,145 B2
(45) Date of Patent: Sep. 25, 2007

(54) CIGARETTE PACK COMPRISING A SLIDE AND CASE

(76) Inventors: Heinz Focke, deceased, late of Verden (DE); by Doris Focke, legal representative, Moorstrasse 64, 27283 Verden (DE); by Jurgen Focke, legal representative, Burgberg 18, 27283 Verden (DE); Hans-Jurgen Bretthauer, Mockernstrasse 62, 28201 Bremen (DE); Karsten Mutschall, Oestmannsweg 6, 27308 Kirchlinteln (DE)

( * ) Notice: Subject to any disclaimer, the term of this patent is extended or adjusted under 35 U.S.C. 154(b) by 27 days.

(21) Appl. No.: 10/509,561

(22) PCT Filed: Apr. 11, 2003

(86) PCT No.: PCT/EP03/03754

§ 371 (c)(1),
(2), (4) Date: Oct. 28, 2005

(87) PCT Pub. No.: WO03/091130

PCT Pub. Date: Nov. 6, 2003

(65) Prior Publication Data

US 2006/0070896 A1 Apr. 6, 2006

(30) Foreign Application Priority Data

Apr. 25, 2002 (DE) ..... 102 18 558

(51) Int. Cl.
*B65D 85/10* (2006.01)

(52) U.S. Cl. ..... 206/267

(58) Field of Classification Search ..... 206/1.5, 206/242, 265, 267, 270, 271, 273, 248, 268; 229/160.1, 122, 125.125
See application file for complete search history.

(56) References Cited

U.S. PATENT DOCUMENTS

| | | | | |
|---|---|---|---|---|
| 2,864,533 | A | 12/1958 | Nyden | |
| 3,311,283 | A * | 3/1967 | Shimada et al. | 229/160.1 |
| 3,773,245 | A | 11/1973 | Meyers | |
| 3,933,299 | A | 1/1976 | Shimada | |
| 4,049,117 | A * | 9/1977 | Grimm | 206/270 |
| 4,050,622 | A | 9/1977 | Shimada | |
| 4,267,926 | A * | 5/1981 | Toimil | 206/268 |
| 4,646,960 | A * | 3/1987 | Challand | 206/268 |
| 6,474,468 | B1 * | 11/2002 | Griffith | 206/267 |

FOREIGN PATENT DOCUMENTS

CH 370699 A 7/1963

(Continued)

OTHER PUBLICATIONS

Deutsches Patent und Markenamt (German Patent Office search report on parent application.

*Primary Examiner*—Luan K Bui
(74) *Attorney, Agent, or Firm*—Laurence P. Colton; Smith, Gambrell & Russell

(57) ABSTRACT

A cigarette pack with a shell (10) and slide (11), the range of movement of the slide (11) within the shell (10) is limited, in particular by stops formed, on the one hand, on a stop tab (30) and, on the other hand, by a recess (34) in the shell (10). The stops help to define a closed position of the slide (11) and an open position.

10 Claims, 5 Drawing Sheets

FOREIGN PATENT DOCUMENTS

| | | | |
|---|---|---|---|
| DE | 1052308 | B | 3/1959 |
| DE | 1285948 | B | 12/1968 |
| DE | 7525528 | U | 12/1975 |
| DE | 2809548 | A | 9/1978 |
| DE | 2916372 | C2 | 6/1984 |
| DE | 3933455 | A1 | 4/1991 |
| GB | 388971 | A | 3/1933 |

* cited by examiner

Fig.4
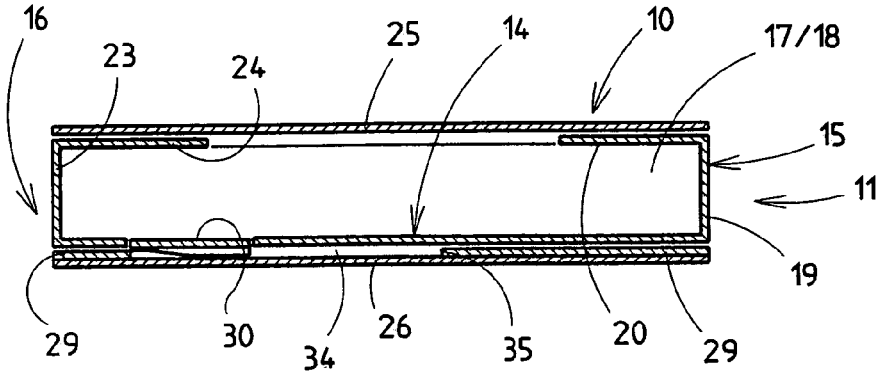
Fig.5
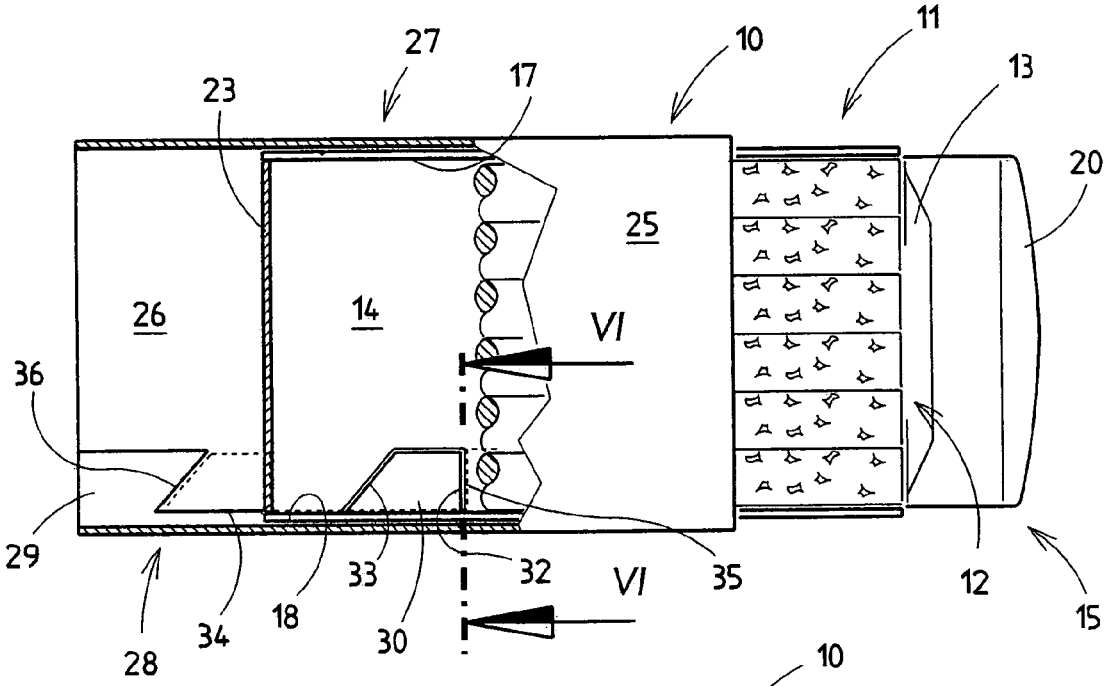
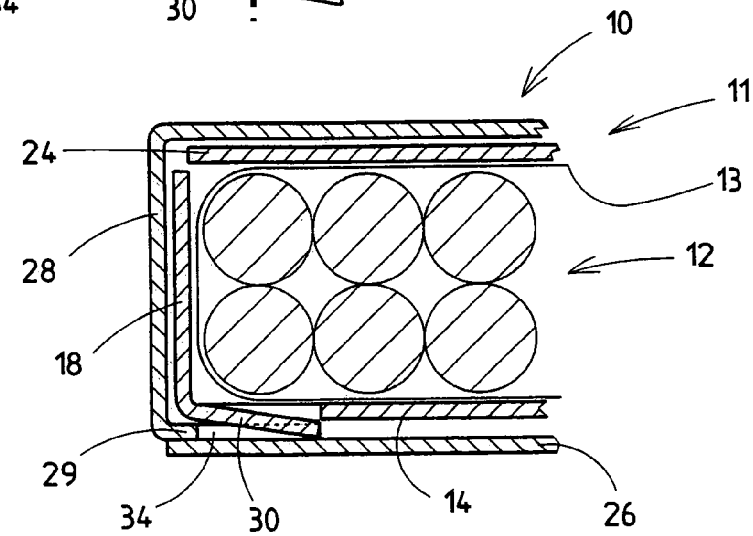
Fig.6

Fig. 7
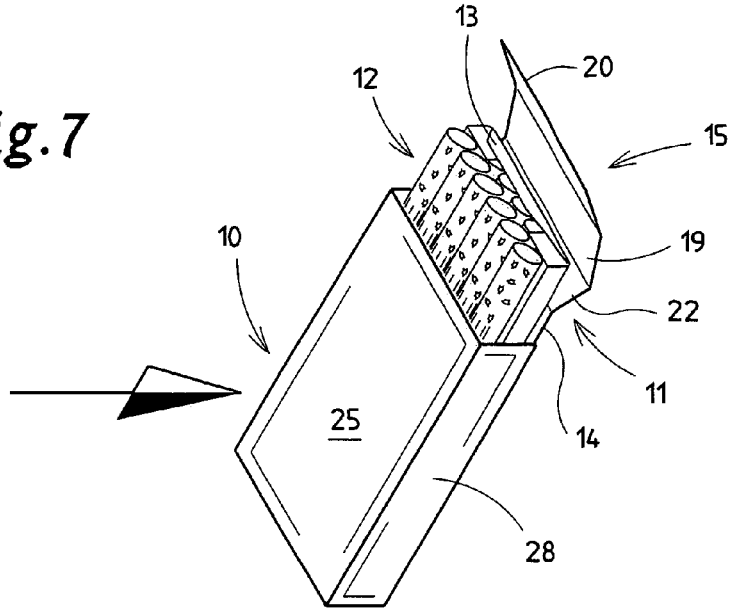
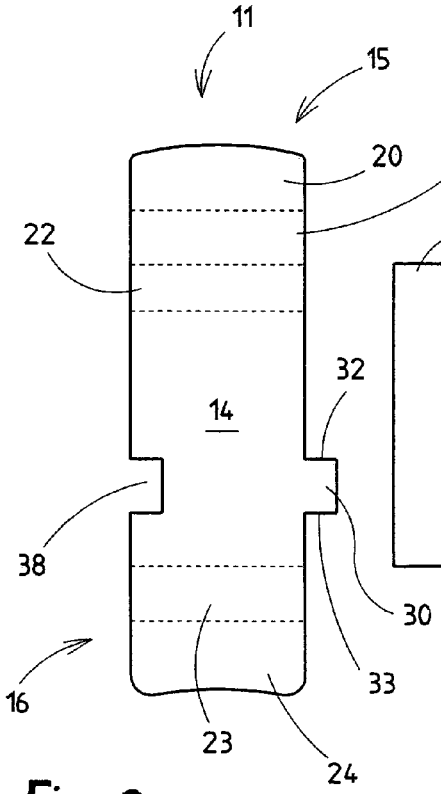
Fig. 8
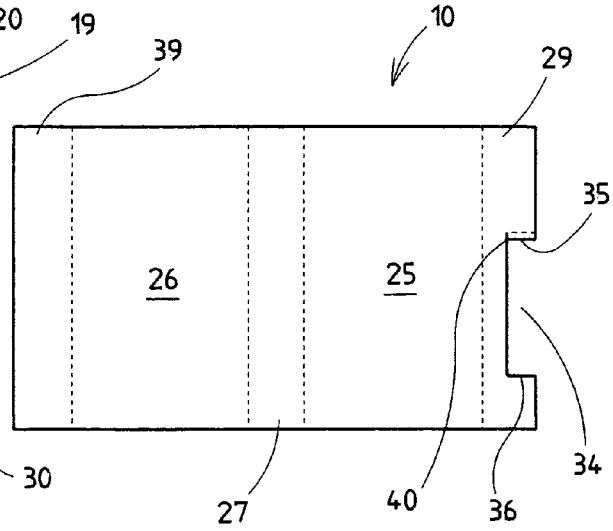
Fig. 9

Fig. 10
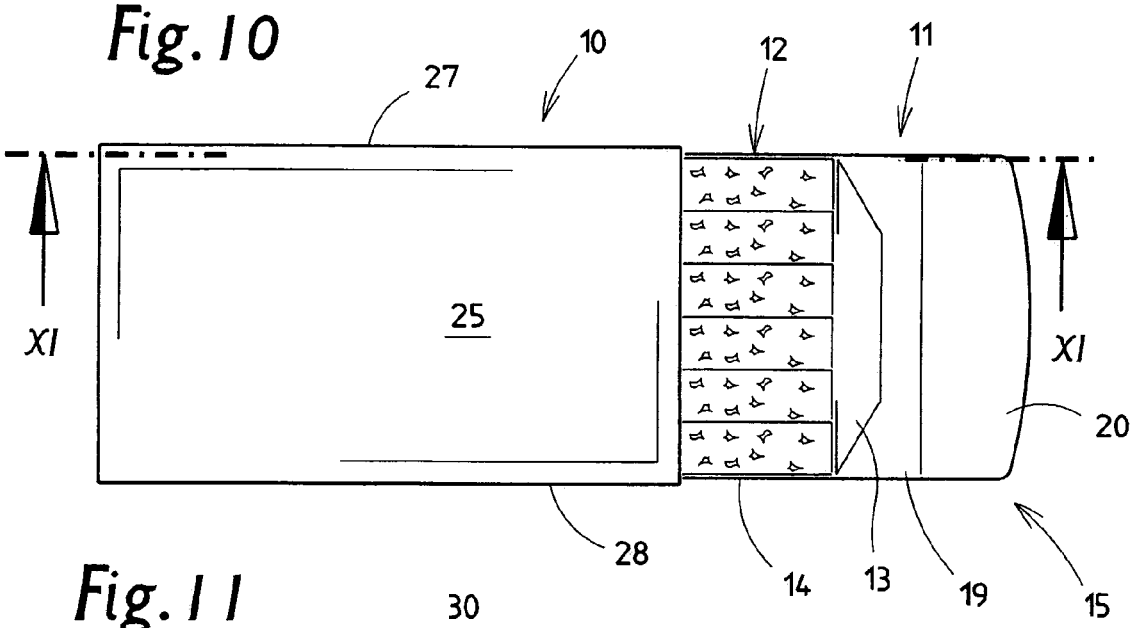
Fig. 11
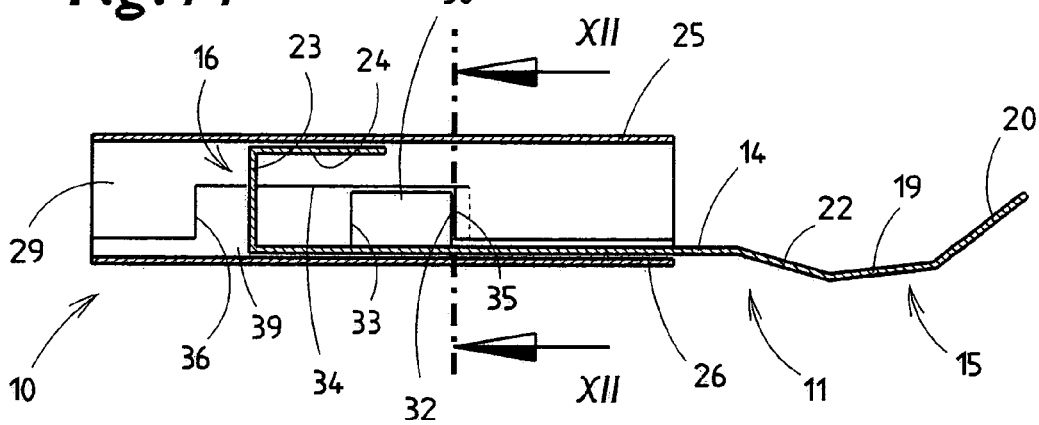
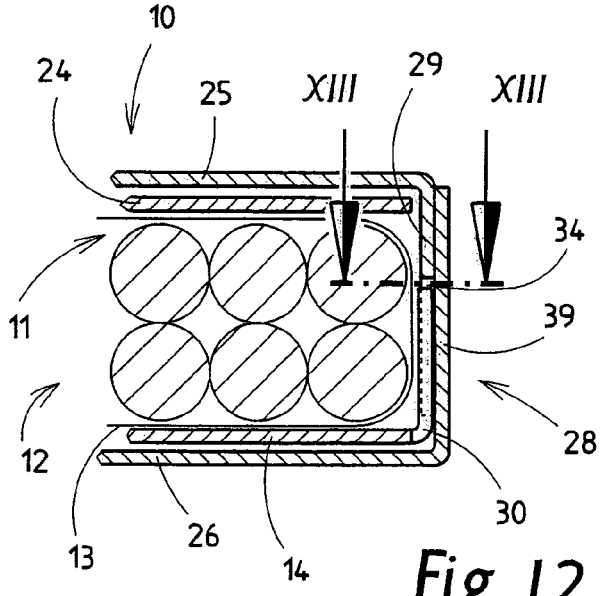
Fig. 12
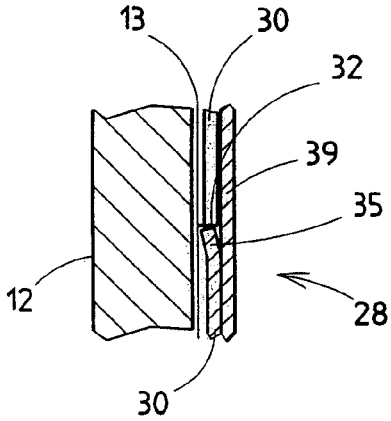
Fig. 13

Fig.14
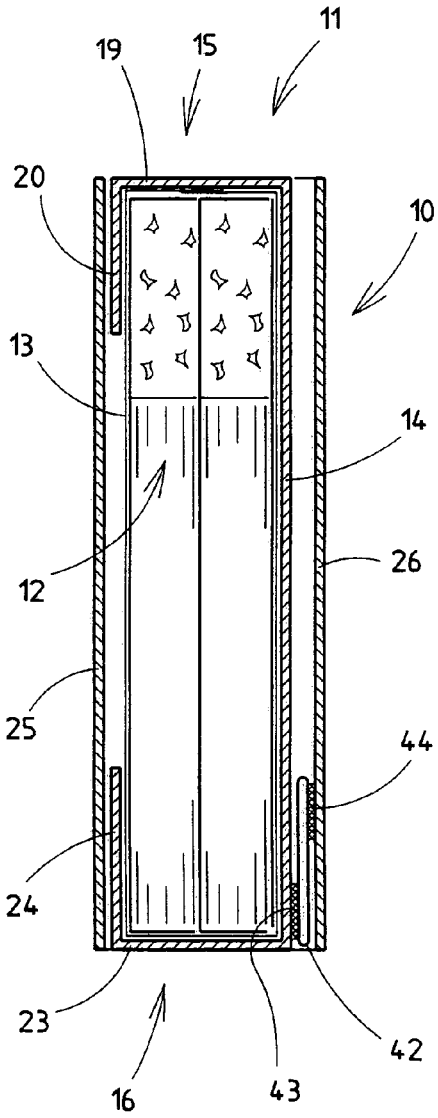
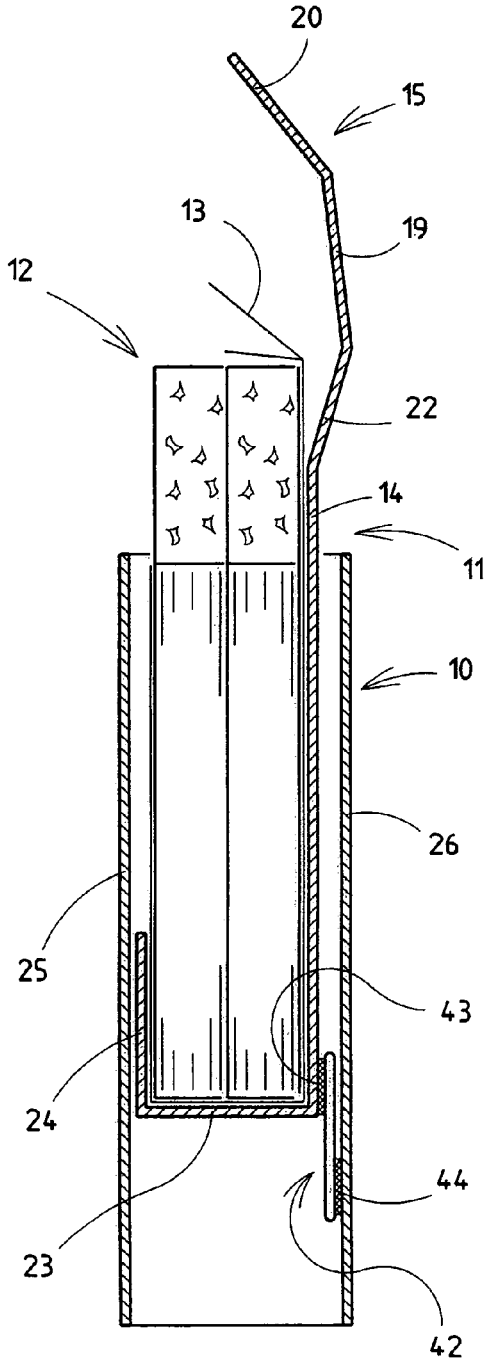
Fig.15

CIGARETTE PACK COMPRISING A SLIDE AND CASE

STATEMENT OF RELATED APPLICATIONS

The above-captioned patent application is the Unites States Patent Cooperation Treaty (PCT) Chapter II National Phase of International Application No. PCT/EP03/03754, having an International Application Date of 11 Apr. 2003, which in turn claims priority on German Patent Application No. 10218558.1, having a filing date of 25 Apr. 2002, designating the United States of America.

BACKGROUND OF THE INVENTION

1. Technical Field

The invention relates to a pack having a slide and an outer shell which at least partially encloses the slide, is open at both ends and is intended, in particular, for accommodating a cigarette group, the slide having at least one base wall.

2. Prior Art

Cigarette packs configured with shells and slides are known internationally, although up until now they have not been used as widely for cigarettes as hinge-lid boxes or soft-carton packs. In the case of slide and shell packs, the cigarette group is enclosed by an inner blank made of tin foil or paper. The resulting cigarette block is seated in the slide comprising a base wall, side walls and an end flap and closure flap. For removal of the pack contents, the slide is pushed part of the way out of the shell, with the result that the pack contents are exposed in the region of the closure flap.

BRIEF SUMMARY OF THE INVENTION

The object of the invention is to improve the handling of packs, in particular cigarette packs, of the slide and shell type without changing the outer appearance or increasing the production outlay.

In order to achieve this object, the pack according to the invention is characterized in that, as a result of stops or connecting means arranged within the shell, the slide can only be pushed to a limited extent out of the shell. The stops or connecting means preferably take effect such that, on the one hand, the slide can be moved into a predetermined open position and, on the other hand, the closed position is defined such that it terminates flush with the shell.

In the case of an advantageous embodiment, at least one stop is arranged on the slide, this stop interacting with one or two mating stops in the interior of the shell. The stop of the shell is formed by a stop flap which is formed part of the base wall or in the region of side flaps. In the case of a particular configuration of the invention, the mating stops are formed by peripheries of a recess which is produced by being punched out of overlapping folding tabs or connecting tabs of the shell.

As an alternative, a deformable, elastic connecting means is provided, within the shell, between the slide and shell. This connecting means limits the movement amplitude of the slide.

BRIEF DESCRIPTION OF THE DRAWINGS

Exemplary embodiments of the pack are explained in more detail hereinbelow with reference to the drawings, in which:

FIG. 4 shows the longitudinal section of the pack according to FIG. 1, in the closed position, FIG. 5 shows a plan view, partly in section, of the pack according to FIG. 4, in the open position, FIG. 6 shows part of the pack according to FIG. 5 along a cross-sectional plane VI-VI from FIG. 4, FIG. 7 shows an illustration, analogous to FIG. 1, of another exemplary embodiment of the pack, FIG. 8 shows a spread-out blank of a slide for the pack according to FIG. 7, FIG. 9 shows a spread-out blank of a shell for the pack according to FIG. 7, FIG. 10 shows a plan view, on an enlarged scale and in the open position, of the pack according to FIG. 7, FIG. 11 shows a longitudinal section through the pack according to FIG. 10 along section plane XI-XI, FIG. 12 shows, on an enlarged scale, a detail of the pack according to FIG. 11 in cross section along section plane XII-XII, FIG. 13 shows a detail of the pack according to FIG. 12 along section plane XIII-XIII, FIG. 14 shows a further embodiment of a slide and shell pack in vertical section, in the closed position, and FIG. 15 shows the pack according to FIG. 14 in the open position.

DETAILED DESCRIPTION OF THE PREFERRED EMBODIMENTS

The packs of the slide and shell type which are shown comprise two parts, namely an outer shell 10 and a slide 11 which can be moved therein, both being made, in particular, of thin cardboard.

A cigarette group 12 comprising two rows of cigarettes is shown as the content of the pack. The cigarette group 12 is enclosed by an inner blank 13 and thus forms a cigarette block, which fits in the pack.

Figure 1:
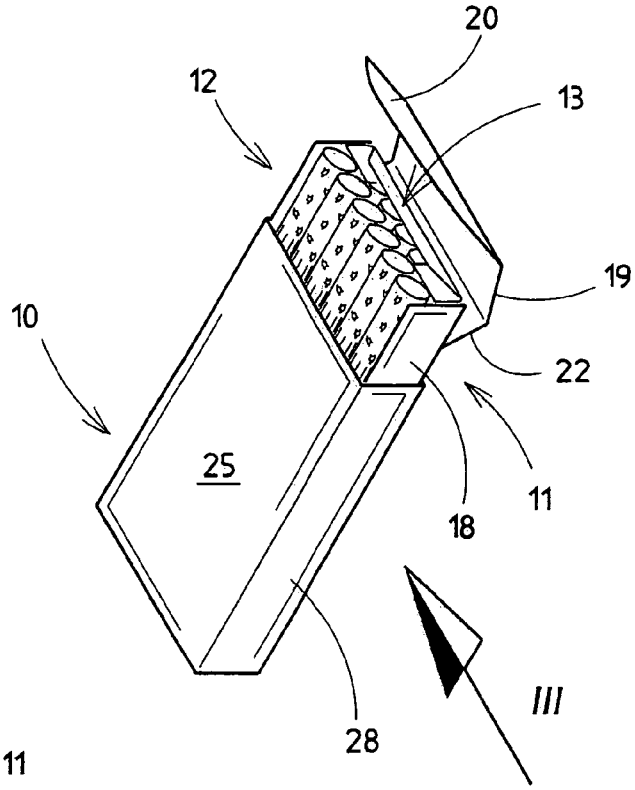
FIG. 1 shows a perspective illustration of a cigarette pack with a slide and shell in the open position.
Figure 2:
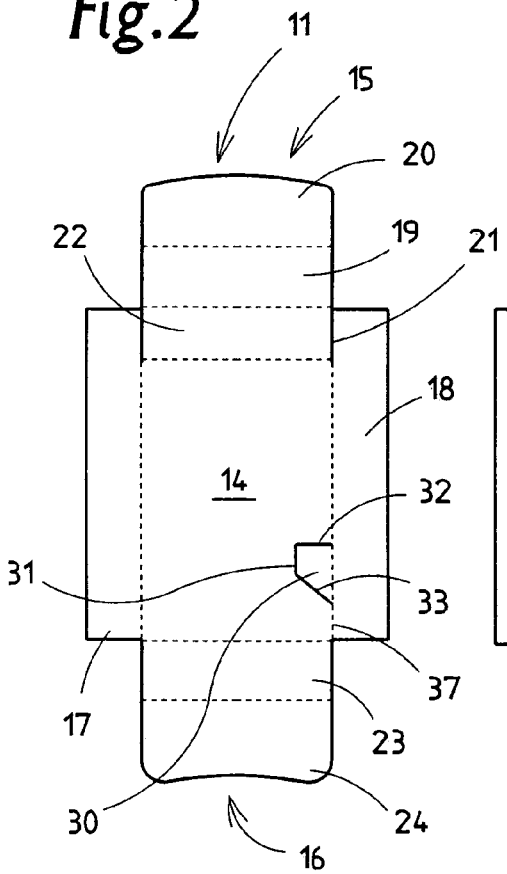
FIG. 2 shows a blank for a slide in the spread-out position.
Figure 3:
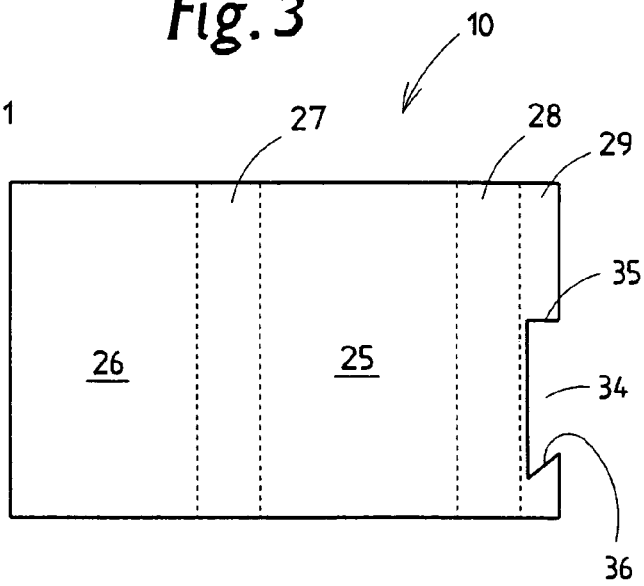
FIG. 3 shows a spread-out blank of a shell.

The shell 10 and slide 11 each comprise separate blanks. In the case of the exemplary embodiment according to FIGS. 1 to 6, the slide 11 comprises a supporting wall or base wall 14 and mutually opposite insertion flaps, namely a closure flap 15 and an opposite end flap 16. Side flaps 17, 18 are provided laterally on the base wall 14. Once folding of the slide 11 has been finished, these side flaps are folded into an upright position, with the result that the slide 11 has a U-shaped cross section in the region of the base wall 14.

The closure flap 15 comprises an end wall 19 and an insertion flap 20 adjoining the same. Punch cuts 21 delimit the closure flap 15 from the side flaps 17, 18, with an intermediate wall 22 being formed in the process. The individual regions or blank walls are delimited from one another by folding lines, which are illustrated in the drawings by dashed lines.

The end flap 16 comprises two regions, namely an end wall 23 and an insertion flap 24 adjoining the same.

As can be seen from FIG. 4 in particular, the pack contents—cigarette block—are/is at least partially enclosed by the slide 11 on all sides in the closed position of the pack. The end wall 19 butts against one end of the cigarettes or of the cigarette block—in the region of filters in the case of filter cigarettes—while the end wall 23 butts against opposite ends of the cigarettes in the cigarette block. The insertion flaps 20 and 24 butt against the cigarette block on the side which is located opposite the base wall 14.

The shell 10 forms a top wall 25, a bottom wall 26 located opposite the latter, and narrow, elongate side walls 27, 28. In order to form a hollow body of rectangular cross section which is open at both ends, a peripheral tab 29 of the blank of the shell 10 is connected, namely adhesively bonded, to a free peripheral region of the bottom wall 26. The peripheral tab 29 here butts against the inside of the bottom wall 26. The shell 10 encloses the slide 11 together with the cigarette block such that the base wall 14 butts against the inside of the bottom wall 26. The side flaps 17, 18 are in contact with the inside of the side walls 27, 28.

The pack is designed such that at least one end position of the slide 11 relative to the shell 10, but preferably two end positions thereof, is/are fixed by elements arranged in a concealed manner on the inside. One of these positions is an open position corresponding to FIGS. 1 and 2. In this case, the slide 11 projects out of the shell 10 to the extent where free access to the cigarette group 12 is possible—following prior removal of a flap of the inner blank 13. The closed position (FIG. 4) is likewise fixed, that is say a position in which the slide 11 terminates flush with the shell 10.

One special feature is the end positions of the slide 11 being provided with the aid of stops and mating stops. According to FIGS. 1 to 6, a stop tab 30 is formed laterally on the slide 11 as part of the slide 11. Punching 31, which bounds the stop tab 30, is provided in the region of the base wall 14 of the slide 11. The stop tab 30 extends as far as the slide flap 18. When the pack is used, two mutually opposite stop edges 32 and 33 of the stop tab 30 can take effect.

Mating elements, namely mating stops, are formed on the inside of the shell 10, in the present case in the region of the bottom wall 26. The mating stop is part of the peripheral tab 29 or is formed by the latter. The peripheral tab 29, which rests on the bottom wall 26 on the inside, is provided with an (open) recess 34, of which the transversely directed peripheries or edges act as a mating stop, to be precise as an opening stop 35 and closing stop 36.

Once folding of the pack has been finished and the pack has been assembled, the stop tab 30 is located in the region of the recess 34. The stop tab 30 is directed obliquely, that is to say passes out of the plane of the base wall 14 in the downward direction and projects into the recess 34. The position of the stop tab 30 is produced by the material properties, since the stop tab 30 extends as far as a folding edge 37 between the base wall 14 and side tab 18. The projecting region of the stop tab 30 can be displaced within the recess 34, during actuating of the slide 11, until, during an opening movement, the stop edge 32 butts against the associated mating stop, namely against the opening stop 35, and thus fixes the end position. In the case of movement in the opposite direction, the stop edge 33 comes into abutment against the closing stop 36 in accordance with the closed position of the slide 11.

The stop edge 33 and, correspondingly, the edge of the closing stop 36 are directed obliquely. This makes it easier for the slide 11 to be introduced into the shell 10 when the pack is assembled. The stop edge 33, which is located at the front when the slide is pushed in, can be introduced into the shell 10 without catching, until the stop tab 30 is positioned within the recess 34.

In the case of the exemplary embodiment according to FIGS. 7 to 13, a special feature of the pack is constituted by the configuration of the slide 11. The latter comprises the base wall 14, the closure flap 15 and the end flap 16, but does not have any side flaps. The stop system of the pack acts in the region of the side flaps, that is to say in a plane running transversely to the base wall 14. For this purpose, a projecting stop tab 30, which in this example is of rectangular design, is arranged on a free periphery of the base wall 14. For the material-saving production of blanks for slides 11 in the configuration according to FIG. 8, the stop tab 30 has a punched-out portion 38 of the same shape and size formed opposite it.

The shell 10 is also designed in a particular manner, that is to say it has a second peripheral tab 39, located opposite the peripheral tab 29. The two peripheral tabs 29 and 39 together form the side wall 28 of the shell 10, the peripheral tabs 29, 30 overlapping one another and being connected to one another by adhesive bonding or the like. The peripheral tab 39 is located on the outside and extends over the entire height and/or width of the side wall 28.

The inner peripheral tab 29 interacts with the stop tab 30 and has an open recess 34 for this purpose. This recess is rectangular and forms transversely directed stops, namely the opening stop 35 and closing stop 36.

One stop, namely the opening stop 35, is designed in a particular manner, to be precise is bounded by a short incision 40 and is thus provided with an exposed endpiece 41. The latter is deformed inwards (FIG. 13) and thus forms a particularly effective and impassable stop for the stop edge 32 of the stop tab 30.

The pack according to FIGS. 14 and 15 is provided with an element of fundamentally different design for defining end positions of the slide 11. This element is a connecting flap 42 which is provided within the shell 10, between the slide 11 on the one hand and the shell 10 on the other hand. In the case of the exemplary embodiment shown, the connecting flap 42 is positioned in a region which is directed away from the closure flap 15. One end region of the connecting flap 42 is connected to the base wall 14 of the slide 11 and another end region is connected to the bottom wall 26 of the shell 10, in the present case by way of areas of glue 43, 44. The connecting flap 42 consists of a thin, flexible material, for example tear-resistant paper, film or the like. During movement of the slide 11 within the shell, the connecting flap 42 is moved from one straightened-out position into another. One straightened-out position defines the closed position (FIG. 14) and the other straightened-out position defines the open position (FIG. 15). In the case of the exemplary embodiment shown, the connecting flap 42 is designed as a double-layered element, namely as a closed loop, which forms legs lying flatly against one another. As an alternative, the connecting flap 42 may be of single-layered design.

LIST OF DESIGNATIONS

10 shell
11 slide
12 cigarette group
13 inner blank
14 base wall
15 closure flap
16 end flap
17 side flap
18 side flap
19 end wall
20 insertion flap
21 punch cut
22 intermediate wall
23 end wall
24 insertion flap

25 top wall
26 bottom wall
27 side wall
28 side wall
29 peripheral tab
30 stop tab
31 punching
32 stop edge
33 stop edge
34 recess
35 opening stop
36 closing stop
37 folding edge
38 punched-out portion
39 peripheral tab
40 incision
41 end piece
42 connecting flap
43 area of glue
44 area of glue

What is claims is:

1. A pack having a slide (11) and a shell (10) which partially encloses the slide (11) and is open at both ends for accommodating a cigarette group (12), characterized in that:

a) the slide (11) has at least one base wall (14) and can only be moved to a limited extent within the shell (10) as a result of mutually corresponding stops and mating stops on the shell (10) and the slide (11);

b) the shell (10) comprises top wall (25), bottom wall (26) and side walls (27, 28) and has a peripheral tab (29) to which an inner side of the bottom wall (26) is connected;

c) the peripheral tab (29) is provided with a recess (34) that is open at one side;

d) arranged on the base wall (14) of the slide (11) is a stop tab (30), which enters the recess (34) of the peripheral tab (29); and e) transverse edges of the recess (34) form stops (35, 36) for the stop tab (30), which can be moved within the recess (34).

2. The pack as claimed in claim 1, characterized in that the stop tab (30), which is provided on the slide (11), is part of the base wall (14) and projects upwards beyond the plane of the base wall (14) such that at least one sub-region of the stop tab (30) projects into the recess (34).

3. The pack as claimed in claim 1, characterized in that the stop tab (30) adjoins the base wall (14) of the slide (11) laterally and extends transversely or vertically to the base wall (14) in the region of a side wall (28) of the shell (10), the stop tab (30) projecting into the recess (34) formed in the region of the side wall (28).

4. The pack as claimed in claim 2, characterized in that an edge of the recess (34) that forms an opening for the stop tab (30) forms, by way of material deformation, an elevated protrusion for the stop tab (30), by way of deformation of the peripheral tab (29) in the region of the recess (34).

5. The pack as claimed in claim 1, characterized in that an edge of the recess (34) that forms the closing stop (36), that forms a mating stop, is directed obliquely, and that a stop edge (33) of the stop tab (30) facing the closing stop (36) is configured in a correspondingly oblique manner.

6. A pack having a slide (11) and a shell (10) which partially encloses the slide and is open at both ends for accommodating a cigarette group (12), characterized in that:

a) the slide (11) has at least one base wall (14) can only be moved to a limited extent within the shell (10) as a result of mutually corresponding stops and mating stops on the shell (10) and the slide (11);

b) the shell (10) comprises top wall (25), bottom wall (26) and side walls (27, 28), and has a first peripheral tab (29), which is connected to top wall (25) or bottom wall (26), and a second peripheral tab (39), which is connected to bottom wall (26) or top wall (25);

c) the first peripheral tab (29) has a recess (34), which is open at one side;

d) the first peripheral tab (29) is connected to the inner side of the second peripheral tab (39);

e) arranged on the base wall (14) of the slide (11) is a stop tab (30), which enters the recess (34) of the first peripheral tab (29); and f) transverse edges of the recess (34) form stops (35, 36) for the stop tab (30).

7. The pack as claimed in claim 6, characterized in that the stop tab (30), which is provided on the slide (11), is part of the base wall (14) and projects upwards beyond the plane of the base wall (14) such that at least one sub-region of the stop tab (30) projects into the recess (34).

8. The pack as claimed in claim 6, characterized in that the stop tab (30) adjoins the base wall (14) of the slide (11) laterally and extends transversely or vertically to the base wall (14) in the region of a side wall (28) of the shell (10), the stop tab (30) projecting into the recess (34) formed in the region of the side wall (28).

9. The pack as claimed in claim 7, characterized in that an edge of the recess (34) that forms an opening for the stop tab (30) forms, by way of material deformation, an elevated protrusion for the stop tab (30), by way of deformation of the peripheral tab (29) in the region of the recess (34).

10. The pack as claimed in claim 6, characterized in that an edge of the recess (34) that forms the closing stop (36), that forms a mating stop, is directed obliquely, and that a stop edge (33) of the stop tab (30) facing the closing stop (36) is configured in a correspondingly oblique manner.

* * * * *